US008087905B2

(12) United States Patent
Wysk et al.

(10) Patent No.: US 8,087,905 B2
(45) Date of Patent: Jan. 3, 2012

(54) COOLING APPARATUS FOR AN ELECTRONIC DEVICE TO BE COOLED

(75) Inventors: Hans-Joachim Wysk, Villingen-Schwenningen (DE); Karl-Heinz Glatz, Obereschach (DE)

(73) Assignee: Minebea Co., Ltd., Nagano (JP)

( * ) Notice: Subject to any disclaimer, the term of this patent is extended or adjusted under 35 U.S.C. 154(b) by 1022 days.

(21) Appl. No.: 12/016,017

(22) Filed: Jan. 17, 2008

(65) Prior Publication Data

US 2008/0175730 A1 Jul. 24, 2008

(30) Foreign Application Priority Data

Jan. 24, 2007 (DE) ..... 10 2007 003 568

(51) Int. Cl.
*F04B 35/04* (2006.01)

(52) U.S. Cl. ..... 417/356; 165/80.3; 165/122; 361/697; 417/423.7; 310/67 R; 310/64; 310/58

(58) Field of Classification Search ..... 417/356, 417/423.7; 165/80.3, 122; 361/697; 310/67 R, 310/64, 58

See application file for complete search history.

(56) References Cited

U.S. PATENT DOCUMENTS 2,021,894 A * 11/1935 Morse
4,164,690 A * 8/1979 Muller et al.
5,132,780 A * 7/1992 Higgins, III
5,597,034 A * 1/1997 Barker et al. ..... 165/80.3
6,244,331 B1 * 6/2001 Budelman
6,664,673 B2 * 12/2003 Lopatinsky et al.
7,021,894 B2 * 4/2006 Lopatinsky et al. ..... 415/176
7,044,202 B2 * 5/2006 Lopatinsky et al.
2002/0062947 A1 5/2002 O'Connor, Jr.
2006/0021735 A1 * 2/2006 Lopatinsky et al. ..... 165/80.3

* cited by examiner

*Primary Examiner* — Charles Freay
*Assistant Examiner* — Patrick Hamo
(74) *Attorney, Agent, or Firm* — Duane Morris, LLP

(57) ABSTRACT

The invention relates to a cooling apparatus for an electric component such as a CPU, a memory or power semiconductor, such as transistors or LEDs, or a processor. The cooling apparatus comprises a heatsink, an impeller that coaxially encloses the heatsink, and a drive motor for the impeller. The heatsink takes the form of a stationary hub having a base for introducing heat from the electronic component that is to be cooled, the hub widening towards the base. Cooling fins are thermally coupled to the hub, the cooling fins being given a spiral-like curve similar to the blades of the impeller. Due to the special design of the hub and the cooling fins as well as the use of a radial flux motor, a highly efficient, particularly compact cooling apparatus can be realized.

11 Claims, 3 Drawing Sheets

COOLING APPARATUS FOR AN ELECTRONIC DEVICE TO BE COOLED

CROSS-REFERENCE TO RELATED APPLICATIONS

Filed under 35 U.S.C. §371, the present application claims priority under 35 U.S.C. §§119 and 365 of German Patent Application No. 10 2007 003 568.5, filed Jan. 24, 2007, the entirety of which is incorporated herein by reference.

FIELD OF THE INVENTION

The invention relates to a cooling apparatus for an electronic device to be cooled including a heatsink.

BACKGROUND OF THE INVENTION

US 2006/0021735 A1 describes a cooling unit in which a heatsink is integrated in a radial blower. The heatsink comprises a base and heat exchanging means talking the form of spiral cooling fins or cooling pins. The impeller surrounds the heatsink coaxially. A drive motor is designed as a motor with disk-shaped rotor, the rotor being integrated in the impeller and an annular arrangement of stator coils lying opposite to the rotor in an axial direction. The impeller has a large central opening, the stream of air flowing through this central opening in an axial direction towards the cooling fins of the heatsink and from there being conducted in a radial direction over the blades of the impeller and through a lateral outlet. According to this document, it is advantageous to use a motor with disk-shaped rotor rather than a radial flux machine having a hub drive, because in this way the air stream can pass through the central space within the impeller without obstruction of any part of the motor. However, the use of motors with disk-shaped rotors has the disadvantage that the flat coils used for the stator are restricted with respect to the number of their windings and they can only draw a limited amount of current, making them generally less efficient than radial flux machines. In addition, the cooling effect of the cooling unit according to US2006/0021735A1 is not optimal due to the construction of the heatsink and the almost total inclusion of the heatsink in a housing, where only one outlet is open.

U.S. Pat. No. 7,044,202 B2 describes a cooling apparatus for electronic components having a radial flux machine and a central cylindrical hub member that is used to draw off heat from the electronic components. The hub is provided with curved cooling fins and is enclosed by an impeller that has fan blades curved in the same direction. The hub member is relatively voluminous so that only limited space is available for the airflow. In the cooling apparatus of U.S. Pat. No. 7,044,202 B2, air is drawn in an axial direction from both sides and exhausted in a radial direction. The arrangement according to this document seems to be relatively voluminous, so that in relation to its volume, low efficiency is to be expected.

U.S. Pat. No. 7,021,894 B2 describes a cooling apparatus having a heatsink (that essentially has a base and a plurality of cooling pins. These cooling pins are disposed about an annular space, an impeller rotating in the annular space. The impeller is driven by a disk rotor motor.

US 2002/0062947 A1 describes a cooling apparatus that has a similar construction to the cooling apparatus of U.S. Pat. No. 2,021,894 B2, the cooling apparatus being driven, however, by a radial flux machine that is disposed at the center of the impeller. A similar prior art is described in U.S. Pat. No. 6,244,331 B1.

In general, the present invention relates to a cooling system for controlling or regulating the temperature of an electronic device that is to be cooled, and particularly for cooling hot spots on CPUs, memories or power semiconductors such as transistors or LEDs, graphic processors and other processors that are preferably employed in compact and/or mobile electronic appliances such as mobile telephones, PDAs, electronic organizers, navigation systems, mini-laptops and mobile miniature memories.

The removal of surplus, function-critical heat or its reduction to a non-critical level is a key consideration in the design and utilization of many electronic devices. Along with the reduction in size of electronic components and the increase in their performance, there is a rise in the amount of heat generated. Furthermore, modern processors may have increased power consumption and also increasingly efficient electronic power components are being launched on the market. Since these kinds of components are often tightly packed together in increasingly small electronic appliances, the effective cooling of these components using highly efficient, miniaturized cooling devices is a crucial factor in the development of electronic equipment. At the same time it is not only necessary for the cooling device to be small and efficient but it should have a low energy consumption and heat development as well.

As mentioned above, electrically driven blowers having integrated heatsinks for the purpose of cooling electronic components are known in the prior art. An object of the present invention is to improve known cooling devices with respect to their efficiency, while the overall cooling device remains as small and flat as possible and the conduction of the flow of air being optimized.

SUMMARY OF THE INVENTION

The invention provides a cooling apparatus for an electronic device to be cooled having a heatsink, an impeller that coaxially surrounds the heatsink, and a drive motor for the impeller. The heatsink is designed as a stationary hub and has heat exchange elements that are thermally coupled to the hub. According to the invention, the hub has a base for the purpose of introducing heat from the electronic device to be cooled, the outside diameter of the hub widening towards the base. This widening of the diameter may take the form, for example, of a cone, a parabola, a sinus curve, a step or of an arc, the invention not being limited to any specific shape. The cooling apparatus preferably also has a thermally conductive baseplate that is thermally coupled to the base of the hub. Thanks to the increase in diameter of the hub having an enlarged base for the purpose of introducing heat from the electronic device to be cooled, the transfer of heat from the electronic device to the heatsink can be optimized. The base of the hub or the baseplate of the cooling apparatus may, for example, be directly bonded to a heat source, such as a chip, using a thermally conductive adhesive so that the electronic device releases the heat at the center of the hub.

In a preferred embodiment, the heat exchange elements are designed as cooling fins that are connected to the hub. The cooling fins are preferably curved such that they follow the swirl of air produced by the impeller when the impeller is in operation. The impeller itself preferably has fan blades that are curved in the opposite direction to the cooling fins of the heatsink. In the cooling apparatus according to the invention, the airflow enters in an axial direction at the center of the impeller, on the side lying opposite to the baseplate, and is exhausted towards the outside in a radial direction by the impeller. The design of the hub, the cooling fins and the fan blades makes it possible to optimize the airflow, i.e. to maximize it in relation to the volume of the cooling apparatus and the rotational speed.

In a preferred embodiment of the invention, the impeller is journaled within the hub via a shaft. It has an impeller ring that is connected to the shaft via spokes. In a particularly advantageous embodiment of the invention, the spokes are designed such that they extend obliquely in an axial direction or are chamfered in order to generate an axial airflow component in addition to the radial airflow and to thus additionally increase the flow rate through the cooling apparatus.

The drive motor of the cooling apparatus according to the invention comprises a stator and a rotor. The stator is preferably connected to the hub and the rotor is connected to the impeller, the rotor coaxially enclosing the stator. The drive motor is thus realized as a radial flux machine having an external rotor configuration. The stator has a stator stack having stator poles and stator coils mounted on the stator poles. The rotor has a ring magnet or a plurality of single permanent magnets that are coupled to an annular back yoke. The back yoke is preferably integrated in the impeller so as to achieve the most compact construction possible.

For the same overall volume, using a radial flux machine rather than a motor with disk-shaped rotor means greater efficiency, with no restriction to the coil current and the number of coil windings. The stator stack according to the invention may be made extremely flat, built up, for example, of only 3 or 4 thin stator laminations and wound from the outside in a conventional manner. The heatsink may be substantially disposed above the stator stack as well as between the stator poles, so as to make optimal use of the space available. The rotor is integrated in the impeller and thus has almost no additional space requirement. Since the stator is disposed below the heatsink and the rotor radially outside it, these parts do not obstruct the flow of air through the heatsink.

The cooling apparatus according to the invention can be made extremely small, having a diameter, for example, in the magnitude of 16 mm and a height of 4 mm. The heatsink and the baseplate are made of a thermally conductive material, such as metal, aluminum or copper and may be fabricated, for example, by die casting. The impeller may likewise be made of metal, of aluminum for example, or it may be made of plastics as well.

To journal the shaft within the hub, hydrodynamic fluid bearings, sliding bearings made of Teflon for example or even ball bearings may be used. The shaft and the bearings may be made of metal or of plastics.

SHORT DESCRIPTION OF DRAWINGS

The invention is described in more detail below on the basis of a preferred embodiment with reference to the drawings, wherein FIG. 1 shows a perspective exploded view of a cooling apparatus according to an embodiment of the invention;

DETAILED DESCRIPTION

Figure 1:
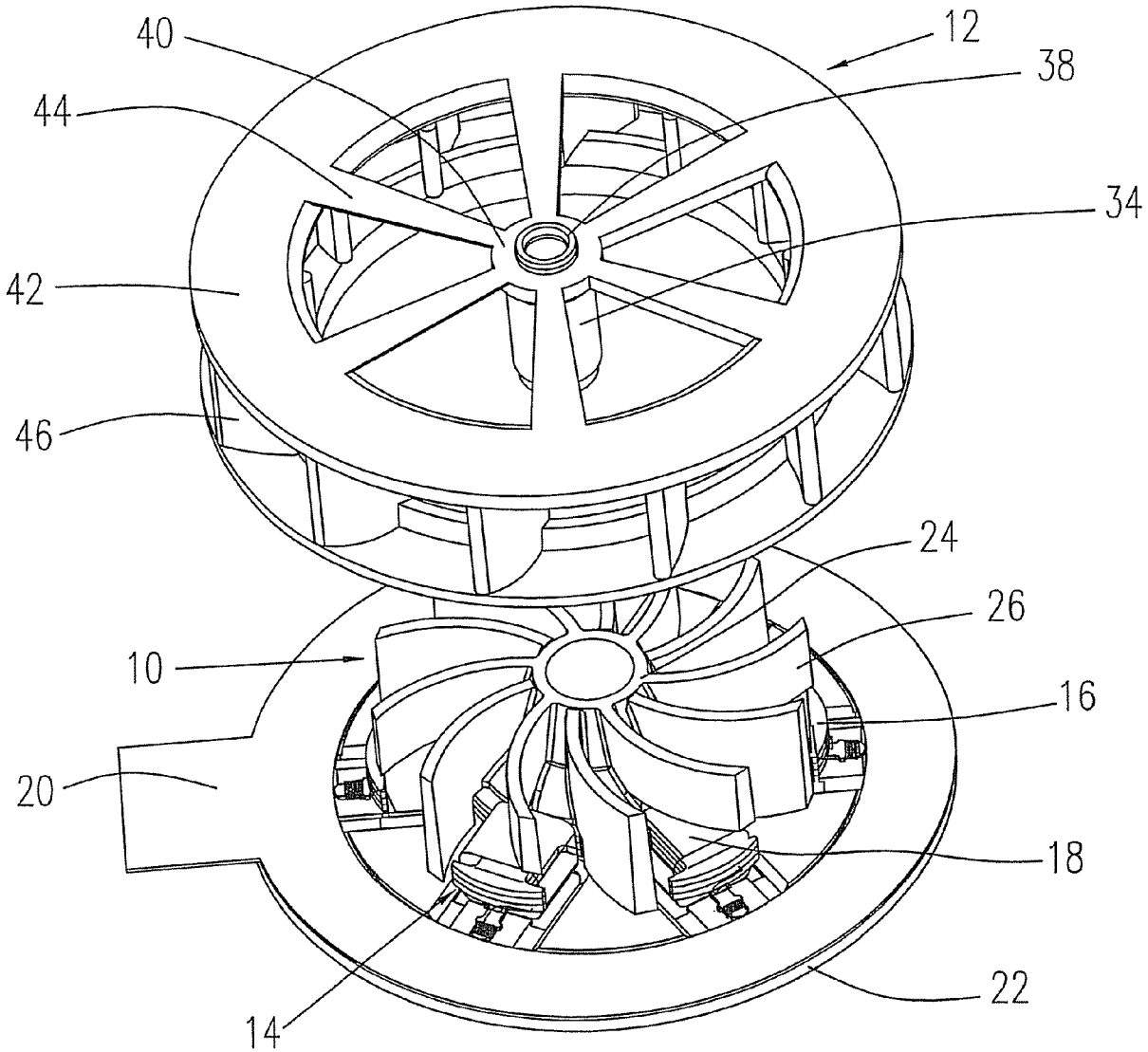
Figure 2:
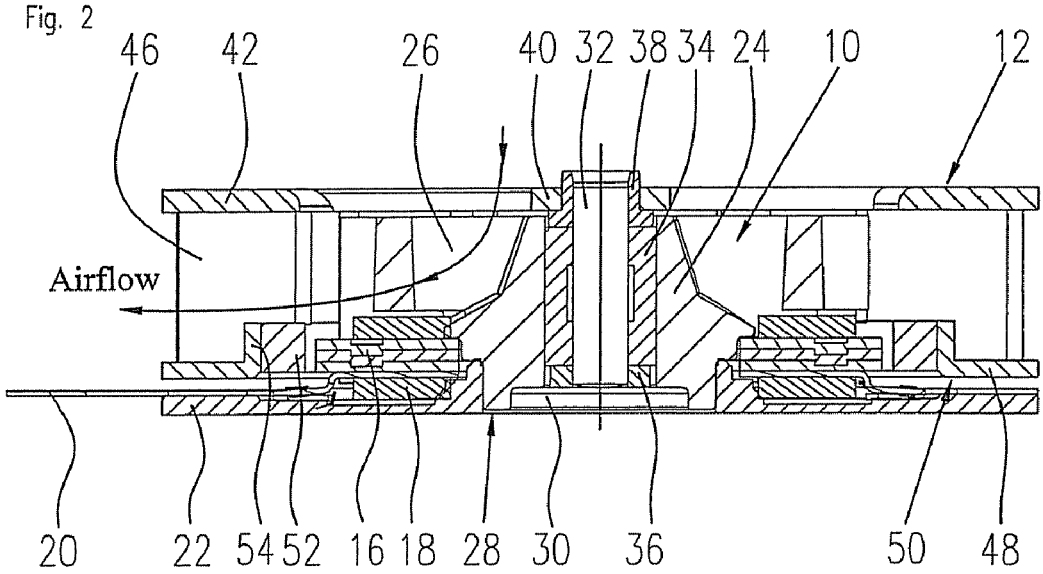
FIG. 2 shows a sectional view through the cooling apparatus of FIG. 1.
Figure 3:
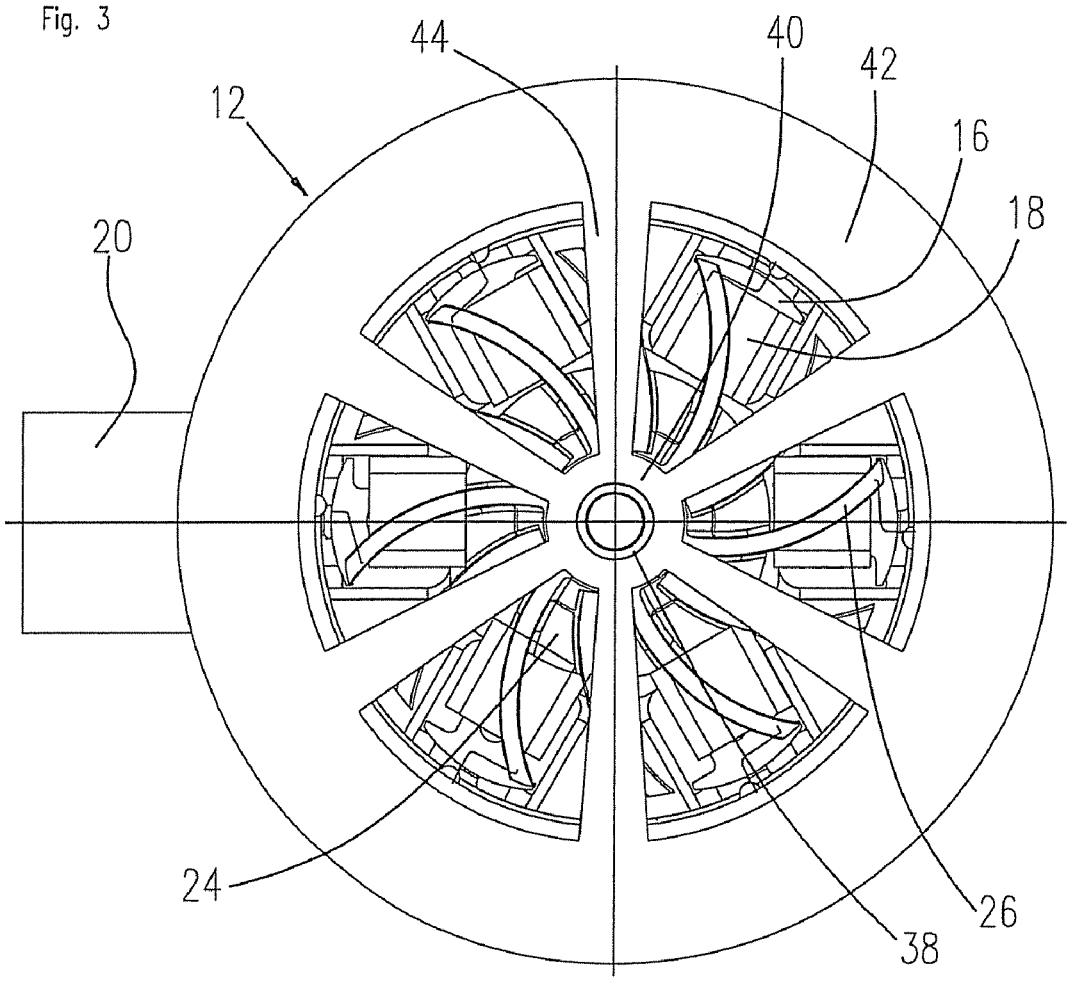
FIG. 3 shows a topview of the cooling apparatus of FIG. 1.

FIGS. 1 to 3 show a preferred embodiment of a cooling apparatus according to the invention. The cooling apparatus comprises a heatsink 10, an impeller 12 and a drive motor 14 of which only the stator 16 is illustrated in FIG. 1. In the illustrated embodiment, the stator 16 is represented by a stator stack or lamination stack having six poles on which stator coils 18 are mounted. The terminals of the stator coils 18 are connected to a circuit board 20 that may also carry sensors to measure the position of the rotor or the heat of the baseplate.

The stator 16 is seated on a baseplate 22 into which the heatsink 10 is inserted. The heatsink 10 comprises a hub 24 and cooling fins 26 that are curved like fan blades such that on rotation of the impeller 12 they follow the swirl of air produced by the impeller. In the illustrated embodiment, the hub 24 of the heatsink 10 takes the form of two cones placed one on top of the other so as to form the largest possible base 28. In this embodiment, the hub widens in an axial direction towards the base 28, i.e. its diameter in the region of the baseplate 22 is larger than its diameter at the end face remote from the baseplate 22. In the illustrated embodiment, the hub 24 is closed at its end facing the baseplate 22 by a counter plate 30, wherein the counter plate 30 may also be formed integrally with the hub 24 and it may constitute a part of the base 28 of the hub 24.

In the context of this invention, the term "widening of the diameter" of the hub means that the outside diameter of the hub increases from the end face remote from the baseplate 22 towards the end face facing the baseplate 22, also incorporated, however, are those embodiments whose hub 24 again shows a decrease in diameter in the region in which it is inserted into the baseplate 22, as shown in FIG. 2. Of key importance for the shape of the hub according to the invention, is that first the outside diameter of the hub 24 increases towards the base 28 so that the material volume of the hub 24 is larger there where the hub is connected to the baseplate 22 than at the remote end face of the hub 24. Owing to this special design, the heat capacity of the hub is increased particularly in the region in which the heat is introduced, i.e. in the region of the baseplate, without restricting the space available for the airflow. The airflow actually enters at the axial end of the hub remote from the baseplate where its diameter is smaller, so that a larger space is made available for the air input.

The baseplate 22, the hub 24 and the counter plate 30 are made of a good thermally conductive material, such as aluminum or copper, so that the heat introduced by an electronic device, such as a chip, can be effectively drawn up by the hub 24 and passed on to the cooling fins 26. The electronic device that is to be cooled is disposed as centrally as possible directly under the hub 24 and the baseplate 22 and connected to these parts using, for example, a thermally conductive adhesive.

A shaft 32 is journaled at the center of the hub 24, a sliding bearing 34 being used in the illustrated embodiment. Other bearings, such as hydrodynamic bearings and ball bearings may be used as an alternative. The sliding bearing 34 is fixed at its end facing the counter plate 30 by a stopper ring 36. At the opposing end face, the shaft 32 is coupled to the impeller 12 using a connecting ring 38.

The impeller has an inner 40 and an outer ring 42 that are connected to each other via spokes 44. Fan blades 46 are disposed at the outer ring 42, the fan blades enclosing the cooling fins 26 coaxially and curved in the opposite direction to the cooling fins.

On the side of the fan blades 46 remote from the outer ring 42, the fan blades are connected via a guiding ring 48 that is associated with the rotor 50. In the illustrated embodiment, the rotor 50 comprises a rotor magnet 52 taking the form of a ring magnet. The guiding ring 48 further comprises a back yoke 54 facing the rotor magnet, the back yoke being preferably formed integrally with the guiding ring and made of metal. The ratio of the number of poles of the rotor to the number of stator slots can be set according to the required operational parameters. In the illustrated embodiment, the impeller 12 turns in an anti-clockwise direction, so as to produce a stream of air that flows into the cooling apparatus through the axial opening of the impeller 12, past the hub 24 and the cooling fins 26 and out of the impeller 12 in a radial direction. The airflow is indicated in FIG. 2 by arrows.

In order to increase the speed of air flowing in an axial direction into the cooling apparatus, the spokes 44 are chamfered or disposed obliquely, so as to generate an axial airflow component. This can be seen best in FIG. 1.

Figure 4:
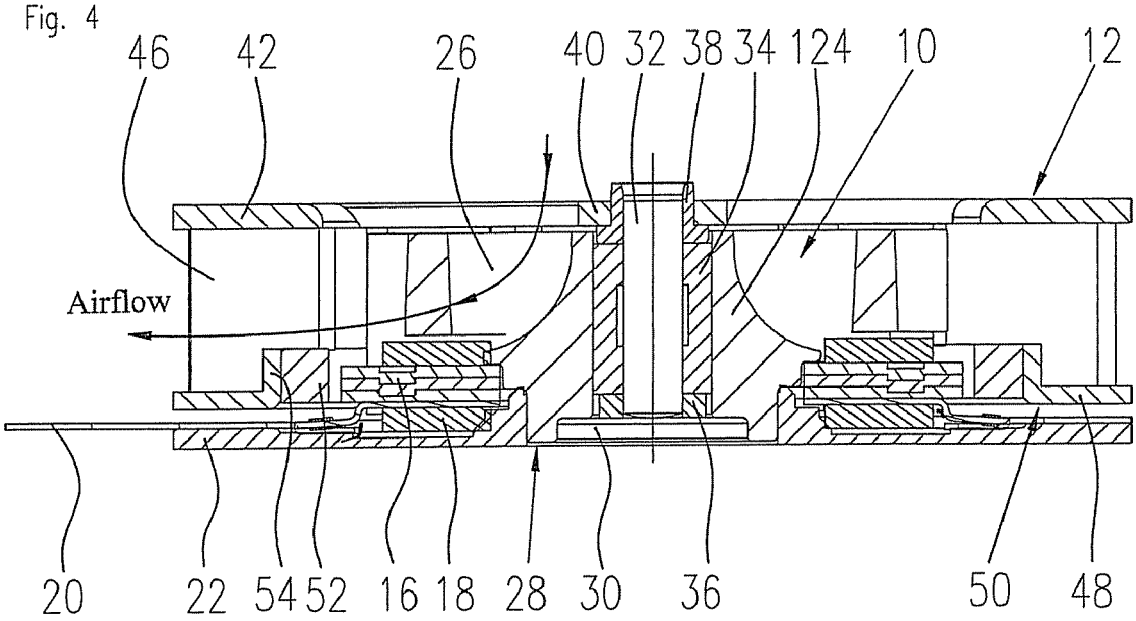
FIG. 4 shows a sectional view through a cooling apparatus according to an alternative embodiment of the invention.

FIG. 4 shows a sectional view through a cooling apparatus according to an alternative embodiment to FIG. 1. The embodiment of FIG. 4 differs from the embodiment of FIG. 1 to 3 by the shape of the hub 124. All other components of the cooling apparatus of FIG. 4 may be identical. They are indicated by the same reference numbers and are not described again.

In the embodiment of FIG. 4, the outer contour of the hub 124 takes the shape of an arc, its outside diameter increasing towards the base 28, so that the material volume of the hub 124 on the side where the hub is connected to the baseplate 22 is greater than at the remote end face of the hub 124. As an alternative to the illustrated embodiments, the outer contour of the hub may also take the form of a parabola, an ellipse, a sinus, a step or any other free form, wherein the form should be flow-favorable and not obstruct the flow of air.

The cooling apparatus according to the invention has a number of advantages. It can achieve high efficiency at a low overall volume. It achieves this by using a drive motor that itself is highly efficient and has low energy consumption combined with all the advantages of a standard radial flux machine having a hub drive. The number of windings of the stator coils is not subject to the limitations of a disk rotor motor, and the ratio of the number of poles to the number of slots can be set according to requirements. Due to the especially widening hub shape, the cooling apparatus according to the invention can optimally draw off heat from the electric device and transfer it to the cooling fins without obstructing the flow of air. The design of the cooling fins 26, the fan blades 46 as well as the spokes 44 produces an optimal flow of air in an axial direction into the cooling apparatus that is exhausted in a radial direction. The cooling apparatus according to the invention is particularly suited to cooling hot spots, i.e. localized sources of heat, on CPUs, memories, power semiconductors, processors and suchlike. It is preferably utilized in small-scale, mobile electronic appliances such as mobile telephones, PDAs, mini-laptops, navigation systems and suchlike.

The cooling apparatus according to the invention can also be used to cool power LEDs in the automobile sector, for example, or in projectors. Here the LED that is to be cooled or a LED unit made up of several LEDs is placed on a good thermally conductive circuit board made, for example, of metal or ceramics. The cooling apparatus is then fixed to this circuit board so that the baseplate is thermally coupled to the circuit and can thus draw heat away from the LED. The blower can also be connected directly above the circuit board of the LED, thus producing a particularly compact construction.

The characteristics revealed in the above description, the claims and the figures can be important for the realization of the invention in its various embodiments both individually and in any combination whatsoever.

| List of Reference signs | |
|---|---|
| 10 | Heatsink |
| 12 | Impeller |
| 14 | Drive motor |
| 16 | Stator |
| 18 | Stator coils |
| 20 | Circuit board |
| 22 | Baseplate |
| 24 | Hub |
| 26 | Cooling fins |
| 28 | Base |
| 30 | Counter plate |
| 32 | Shaft |
| 34 | Sliding bearing |
| 36 | Stopper ring |
| 38 | Connecting ring |
| 40 | Hub |
| 42 | Outer ring |
| 44 | Spokes |
| 46 | Fan blades |
| 48 | Guiding ring |
| 50 | Rotor |
| 52 | Rotor magnet |
| 54 | Back yoke |
| 124 | Hub |

We claim:

1. A cooling apparatus for an electronic device to be cooled comprising:

(a) a heatsink;

(b) an impeller that coaxially encloses the heatsink; and, (c) a drive motor for the impeller;

the heatsink taking the form of a stationary hub and comprising heat exchange elements that are thermally coupled to the hubs, wherein the hub has a base for introducing heat from the electronic device that is to be cooled and the outside diameter of the hub widens towards the base, and wherein the drive motor has a stator that is connected to the hub, and a rotor that is connected to the impeller, the rotor coaxially enclosing the stator and having one or more permanent magnets.

2. A cooling apparatus according to claim 1, wherein the widening of the diameter of the hub is conical, parabolic, sinoid, arc-shaped or stepped in design.

3. A cooling apparatus according to claim 1, further comprising a thermally conductive baseplate that is thermally coupled to the base of the hub.

4. A cooling apparatus according to claim 1, wherein the heat exchange elements take the form of cooling fins that are connected to the hub.

5. A cooling apparatus according to claim 4, wherein the cooling fins are curved so that in operation they follow the swirl of air produced by the impeller.

6. A cooling apparatus according to claim 5, wherein the impeller has fan blades that are curved in the opposite direction to the cooling fins of the heatsink so as to produce a radial flow of air.

7. A cooling apparatus according to claim 1, wherein the impeller is rotationally supported within the hub via a shaft.

8. A cooling apparatus according to claim 7, wherein the impeller has an impeller ring that is connected to the shaft via spokes, the spokes extending obliquely in an axial direction or being chamfered, so as to produce an axial airflow component.

9. A cooling apparatus according to claim 1, wherein the stator has a stator stack and stator coils mounted on the stator stack.

10. A cooling apparatus according to claim 1, wherein the rotor has an annular back yoke, the back yoke being integrated in the impeller.

11. A cooling apparatus according to claim 9, wherein the rotor has one or more permanent magnets and an annular back yoke, the back yoke being integrated in the impeller.

* * * * *